US007771038B2

(12) United States Patent
Araya et al.

(10) Patent No.: US 7,771,038 B2
(45) Date of Patent: Aug. 10, 2010

(54) PRINTING APPARATUS AND PRINTING METHOD

(75) Inventors: Midori Araya, Nagano (JP); Keisuke Haba, Nagano (JP); Hajime Wada, Nagano (JP); Naruhiko Katagiri, Nagano (JP); Yu Shinagawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 973 days.

(21) Appl. No.: 10/530,174

(22) PCT Filed: Oct. 2, 2003

(86) PCT No.: PCT/JP03/12672

§ 371 (c)(1),
(2), (4) Date: Nov. 9, 2005

(87) PCT Pub. No.: WO2004/030913

PCT Pub. Date: Apr. 15, 2004

(65) Prior Publication Data

US 2006/0109325 A1 May 25, 2006

(30) Foreign Application Priority Data

Oct. 3, 2002 (JP) ..... 2002-291153
Feb. 6, 2003 (JP) ..... 2003-029569
Sep. 25, 2003 (JP) ..... 2003-333552

(51) Int. Cl.
*B41J 2/17* (2006.01)

(52) U.S. Cl. ..... 347/101; 347/104

(58) Field of Classification Search ..... 347/101, 347/104

See application file for complete search history.

(56) References Cited

U.S. PATENT DOCUMENTS 5,623,295 A * 4/1997 Kishi et al. ..... 347/111
5,854,648 A 12/1998 Hanabusa
6,724,999 B2 * 4/2004 Kikuchi et al. ..... 399/69
6,930,696 B2 * 8/2005 Otsuki ..... 346/16
2001/0038411 A1 * 11/2001 Sasaki et al. ..... 347/212
2003/0030712 A1 * 2/2003 Kawaguchi et al. ..... 347/104

FOREIGN PATENT DOCUMENTS

EP 1193072 A2 * 4/2002
JP 4-090354 A 3/1992
JP 4-112149 A 4/1992
JP 5-004432 A 1/1993

(Continued)

*Primary Examiner*—Laura E Martin
(74) *Attorney, Agent, or Firm*—Sughrue Mion, PLLC

(57) ABSTRACT

A printing apparatus is provided. The printing apparatus forms a dot in a desired position of a printing sheet by ejecting an ink droplet from a nozzle. A static electricity eliminating mechanism eliminates static electricity generated on the printing sheet by a conductive portion that is arranged in a position to which the ink droplet is ejected from the nozzle or an upstream side of such position on a path through which the printing sheet passes. The conductive portion is formed in at least one of a sheet feed roller and an idle roller that carry the printing sheet. The sheet feed roller or the idle roller is formed by coating a predetermined insulating coating on a surface of a conductive rod-shaped member. The conductive portion is formed by stripping off a part of the coating on the sheet feed roller or the idle roller.

14 Claims, 16 Drawing Sheets

FOREIGN PATENT DOCUMENTS

| | | | | |
|---|---|---|---|---|
| JP | 10-81008 | A | | 3/1998 |
| JP | 10 081008 | A | | 3/1998 |
| JP | 10081008 | A | * | 3/1998 |
| JP | 10-147035 | A | | 6/1998 |
| JP | 11-005347 | A | | 1/1999 |
| JP | 2000-43243 | A | | 2/2000 |
| JP | 2000043243 | A | * | 2/2000 |
| JP | 2000-289291 | A | | 10/2000 |
| JP | 2000-289292 | A | | 10/2000 |
| JP | 2002-103584 | A | | 4/2002 |
| JP | 2002-192714 | A | | 7/2002 |

* cited by examiner

FIG. 8

| | PP2 PAPER | | PM MAT PAPER | |
|---|---|---|---|---|
| | CHARGED VOLTAGE | SMUDGE OF INK | CHARGED VOLTAGE | SMUDGE OF INK |
| PRIOR ART | 376.8 | × | 930.9 | × |
| STRIPPING OFF AT ONE LOCATION | 332.2 | × | 499.4 | △ |
| STRIPPING OFF AT TWO LOCATION | 170.0 | ○ | 424.8 | ○ |

○ : NOT SMUDGED WITH INK

△ : SMUDGED WITH INK, BUT WITHIN TOLERANT

× : SMUDGED WITH INK, NG LEVEL

FIG. 14

| | PP2 PAPER | | PM MAT PAPER | |
|---|---|---|---|---|
| | CHARGED VOLTAGE | SMUDGE OF INK | CHARGED VOLTAGE | SMUDGE OF INK |
| PRIOR ART | 376.8 | × | 930.9 | × |
| COPPER-FOIL APPLIED | 126.4 | ○ | 412.8 | △ |

○ : NOT SMUDGED WITH INK
△ : SMUDGED WITH INK, BUT WITHIN TOLERANCE
× : SMUDGED WITH INK, NG LEVEL

PRINTING APPARATUS AND PRINTING METHOD

TECHNICAL FIELD

The present invention relates to a printing apparatus and a printing method.

BACKGROUND ART

In the ink-jet printing apparatus, dots are formed in desired positions of the printing paper by ejecting the ink from the nozzle by virtue of the pressure generated by the distortion of the piezoelectric element or the pressure generated by the bubble, and thus characters, figures, etc. are printed on the printing paper.

Meanwhile, in order to improve the resolution of the printed image, recently finer dots are formed by reducing an amount of ink droplets ejected from the nozzle in one ejection operation.

The ejection of the ink is liable to be affected by the static electricity generated by the friction between members in the printing apparatus whenever an amount of ink is reduced in this way. Therefore, a method of providing a static electricity eliminating unit was proposed.

In this case, the ink droplets sometimes stall in the middle of the flight toward the printing paper when an amount of ink is reduced, and thus micro ink droplets floating in the air are generated.

In case the printing paper is charged with the static electricity in the situation in which such micro ink droplets are present, such micro ink droplets are adsorbed by the printing paper to form the dots on unintended portions, and thus in some cases the smudge is generated on the image.

Also, in recent years the printing apparatus having a function of printing the image on the overall area of the printing paper, i.e., a so-called "unframed printing" function is provided. In such printing apparatus, the blank is prevented from being generated by setting a size of the to-be-printed image slightly larger than a size of the printing paper.

In case the size of the image is set somewhat larger than the size of the printing paper in this manner, the ink droplets ejected toward portions that are in excess of the size of the printing paper fly to the ink absorbing material located behind the printing paper, and then are absorbed there.

However, the probability of the ink droplets stalling is enhanced since a distance to the ink absorbing material is longer than a distance to the printing paper. As a result, such a problem exists that the smudge of the printing paper is prone to occur.

Also, in the unframed printing, in order to prevent the event that the omission of the ink distribution occurs in the upper end portion of the printing paper and thus the concerned portion remains still white, sometimes the printing in predetermined color ink on the upper end of the printing paper, i.e., the so-called "waste printing" is carried out before the printing is started after the paper is fed.

In such waste printing, the ink is ejected onto the upper end of the printing paper to draw a streak of fine line. Thus, such problems arise that the ink emitted from the nozzles corresponding to portions except the concerned "line" becomes the foregoing micro ink droplets and that such ink droplets stick to the back surface of the printing paper, for example, to smudge the printing paper.

Also, the case where the ink droplets are ejected toward locations other than the printing paper due to the precision of the printing-paper feeding mechanism occurs except for the waste printing.

In such case, such a problem also exists that the smudge of the printing paper is caused, like the above case.

The subject that the present invention intends to overcome has been made in view of above circumstances, and it is an object of the present invention to provide a printing apparatus and a printing method, capable of preventing a backing of a printing paper from being smudged with a micro ink droplet.

DISCLOSURE OF THE INVENTION

1. A printing apparatus for forming a dot in a desired position of a printing paper by ejecting an ink droplet from a nozzle, comprising:

a static electricity eliminating mechanism for eliminating static electricity generated on the printing paper by a conductive member that is arranged in a position to which the ink droplet is ejected from the nozzle or an upstream side of such position on a path through which the printing paper passes.

According to this configuration, the ink droplet ejected from the nozzle can be prevented from being adsorbed in the unintended position by the influence of the static electricity generated on the printing paper, and also the printing paper can be prevented from being smudged by the micro ink droplet.

2. The printing apparatus further comprises an earthing unit for earthing the conductive member.

According to this configuration, the generated static electricity can be forced to flow into the earth, and the static electricity can be eliminated without fail.

Also, a chassis of the printing apparatus may be selected as the earthing object.

3. The printing apparatus, wherein the conductive portion is formed in a paper feed roller.

4. The printing apparatus, wherein the conductive portion is formed in an idle roller that pushes the printing paper against the paper feed roller with pressure.

According to the configurations in above 3 or 4, the static electricity generated by friction between the paper feed roller and the printing paper can be easily eliminated.

5. A printing apparatus, further comprises an earthing unit for earthing the paper feed roller constituting the conductive portion or the idle roller constituting the conductive portion.

According to this configuration, the generated static electricity can be forced to flow into the earth, and the static electricity can be eliminated without fail.

Also, the chassis of the printing apparatus may be selected as the earthing object for the paper feed roller or the idle roller constituting the conductive portion.

6. The printing apparatus, wherein the paper feed roller or the idle roller is formed by coating a predetermined insulating coating on a surface of a conductive rod-like member, the conductive portion is formed by stripping off a part of the coating on the paper feed roller or the idle roller, and the rod-like member of the paper feed roller or the idle roller is connected to the printing apparatus.

Since the coating is coated in this manner, the friction between the paper feed roller and the printing paper can be increased to execute more effectively the paper feeding, and also the static electricity can be eliminated via the portion from which the coating is stripped off.

7. The printing apparatus, wherein a strip-off portion of the coating on the paper feed roller is formed at least at two locations, and the idle roller is formed to push the printing paper by the strip-off portion.

In this way, since the strip-off portion of the coating on the paper feed roller is divided into plural areas, a friction force between the paper feed roller and the printing paper can be made uniform in the longitudinal direction of the paper feed roller, and also the static electricity can be eliminated more firmly via the portion from which the coating is stripped off.

8. The printing apparatus, wherein the conductive member is a conductive member that is arranged in the position to which the ink droplet is ejected from the nozzle or the upstream side of such position on the path through which the printing paper passes and is connected to a chassis that is different from a paper feed member.

According to this configuration, the static electricity eliminating mechanism can be formed in the portion except the paper feeding unit, and therefore a margin of design of the printing apparatus can be enhanced.

9. The printing apparatus, wherein the conductive member is a conductive member having a sharp tip, and the sharp tip is arranged to be directed to the printing paper.

According to this configuration, since the surface is shaped into a sharp tip shape, the corona discharge is generated from the sharp tip of the conductive member by the point effect. Thus, the charges having the opposite polarity to the charged charges on the printing paper are radiated, and thus the charging can be eliminated (canceled).

10. The printing apparatus, wherein a plurality of projected portions are formed on a contact surface with which the printing paper comes into contact on the path through which the printing paper passes to reduce a contact area.

According to this configuration, since the contact area that comes into contact with the printing paper is reduced on the path through which the printing paper passes, the generated static electricity can be much more reduced.

11. The printing apparatus, wherein material of a member constituting the path through which the printing paper passes is composed by selecting material that is near material of the printing paper in a charging sequence table.

In this fashion, since the material that is near the material of the printing paper in the charging sequence table is selected as the material of a member constituting the path through which the printing paper passes, the generated static electricity can be further reduced.

12. The printing apparatus, wherein a surface of a member constituting the path through which the printing paper passes is coated with material that is near material of the printing paper in a charging sequence table or a surfactant.

In this manner, since the surface of the member constituting the path through which the printing paper passes is coated with the material that is near the material of the printing paper in the charging sequence table or the surfactant, the generated static electricity can be further reduced.

13. A printing apparatus for forming a dot in a desired position of a printing paper by ejecting an ink droplet from a nozzle, comprises a static electricity eliminating mechanism for eliminating static electricity generated on the printing paper by a conductive member that is arranged in a position to which the ink droplet is ejected from the nozzle or an upstream side of such position on a path through which the printing paper passes; and a printing unit for ejecting the ink droplet from the nozzle to an area that is out of a size of the printing paper.

This mechanism is particularly effective in the printing mode in which the ink droplet can be ejected from the nozzle to the area that is out of the size of the printing paper (i.e., the unframed printing mode).

This printing unit includes a member which ejects the ink droplet from the nozzle to the area that is identical to the size (the area that does not exceed the printing size).

14. The printing apparatus, wherein an ink absorbing member for absorbing the ink droplet ejected to an outside of the printing paper is arranged on a platen.

In this case, since the ink droplet that is ejected from the nozzle to the area that is out of the size of the printing paper can be absorbed by the ink absorbing member, the smudge of the unintended portion of the printing paper can be prevented.

Also, this ink absorbing member can be used to absorb the ink droplet when the ink droplet is ejected to the position that is recognized as the essential position of the printing paper due to an error in the printing paper feed portion, or the like, in the printing apparatus that does not have a function of ejecting the ink droplet to the area that is out of the size.

15. A printing method of forming a dot in a desired position of a printing paper by ejecting an ink droplet from a nozzle, comprises a step of carrying the printing paper to a nozzle position; a step of eliminating static electricity generated on the printing paper before the printing paper comes up to the nozzle position; and a step of printing by ejecting the ink droplet from the nozzle after the static electricity is eliminated.

According to this printing method, since the ink droplet is ejected from the nozzle after the charged charge is eliminated from the printing paper, the ink droplet ejected to the printing paper can be prevented from being adsorbed in the unintended position, and also the printing paper can be prevented from being smudged by the micro ink droplet.

16. The printing method, wherein the printing step is a printing mode in which the ink droplet is ejected from the nozzle to an area that is out of a size of the printing paper.

According to this printing method, the ink droplet is ejected from the nozzle after the charged charge is eliminated from the printing paper. Therefore, this method is particularly effective in the case of the unframed printing because the ink droplet ejected to the printing paper can be prevented from being adsorbed in the unintended position and also the printing paper can be prevented from being smudged by the micro ink droplet.

17. The printing method, wherein the static electricity eliminating step is carried out by a static electricity eliminating portion that is formed in a printing paper feed roller portion.

18. The printing method, wherein the static electricity eliminating step is carried out by a static electricity eliminating portion that is formed of a conductive member on which a plurality of projected portions arranged immediately before a nozzle position on a path through which the printing paper passes are formed.

BRIEF DESCRIPTION OF THE DRAWINGS

FIG. 8 is a view comparing a charged quantity of a static electricity generated in the printing paper and a smudge of the printing paper in the printing apparatus according to the first embodiment shown in FIG. 1 with a charged quantity of a static electricity generated in the printing paper and a smudge of the printing paper in the printing apparatus in the prior art.

FIG. 14 is a view comparing a charged quantity of the static electricity generated in the printing paper and a smudge of the printing paper in the printing apparatus according to the second embodiment shown in FIGS. 12 and 13 with a charged quantity of the static electricity generated in the printing paper and a smudge of the printing paper in the printing apparatus in the prior art.

In Figures, a reference symbol 65*a* is a strip-off area (conductive portion), 92 copper foil (conductive member), 95 conductive wire (earthing unit), 100 earthing spring member (earthing unit), and 120*a* convex portion (static-electricity generation preventing mechanism).

BEST MODE FOR CARRYING OUT THE INVENTION

Embodiments of the present invention will be explained with reference to the drawings hereinafter.

Figure 1:
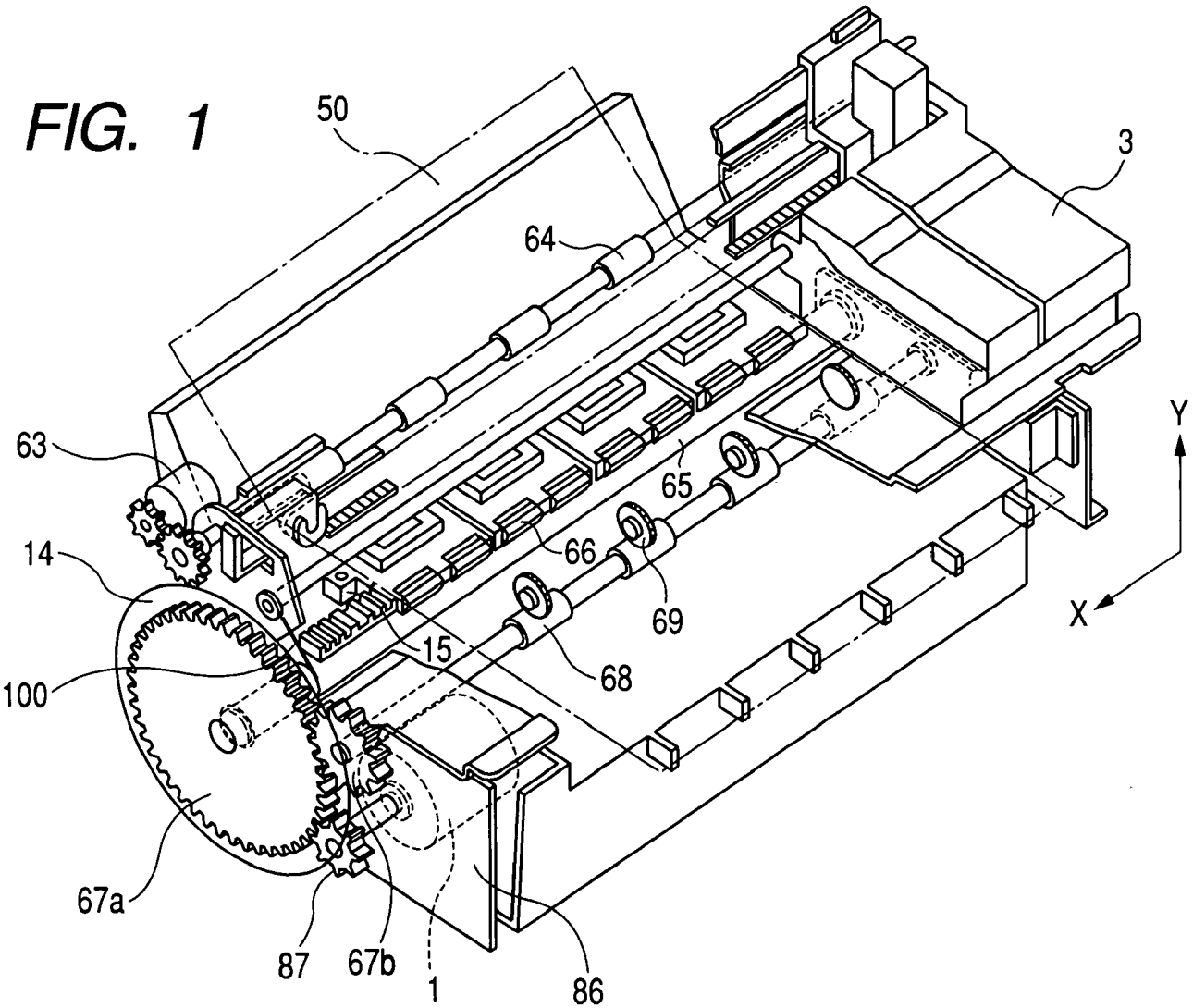
FIG. 1 is a view showing a configurative example of a printing apparatus according to a first embodiment of the present invention.

FIG. 1 is a view showing a configurative example of a printing apparatus according to a first embodiment of the present invention.

As shown in this Figure, the printing apparatus according to the first embodiment of the present invention includes a paper feed motor 1, a carriage 3, an encoder 14, a sensor 15, a paper feed motor 63, a paper feed roller 64, a paper feed roller 65, an idle roller 66, gears 67*a*, 67*b*, a paper discharge roller 68, a knurled roller 69, a chassis 86, a gear 87, and an earthing spring member 100.

Here, the paper feed motor 1 is fixed to the chassis 86, and rotated in response to a control signal from a not-shown control portion to rotate the paper feed roller 65 via the gears 87, 67*a* and rotate the paper discharge roller 68 via the gears 87, 67*b*.

The carriage 3 is reciprocally moved under control of a not-shown carriage motor in the direction (main scanning direction) intersecting orthogonally with the direction (feeding direction) along which a printing paper 50 is fed. The ink is ejected onto desired positions of the printing paper 50 from nozzles provided to a lower surface of the carriage 3 to form the dots.

Now a not-shown ink cartridge is installed into the carriage 3, and the ink stored in this ink cartridge is led to the nozzles provided to a lower surface of the carriage 3.

The encoder 14 is used to sense a rotation angle of the paper feed roller 65 and provide the feedback to the paper feed control. The sensor 15 senses shortage of the paper by sensing whether or not the printing paper 50 is present when the paper feed roller 64 is rotated.

The paper feed motor 63 rotates the paper feed roller 64 in response to the control of the not-shown control portion, and feeds the printing papers 50 stored in a paper feed tray one by one to send the paper to the inside of the printing apparatus.

The paper feed roller 64 is driven by the paper feed motor 63, and feeds the printing papers 50 stored in the paper feed tray one by one to send the paper to the inside of the printing apparatus.

The paper feed roller 65 carries the printing paper 50 in the feeding direction in response to the rotation of the paper feed motor 1.

The idle roller 66 pushes the printing paper 50 against the paper feed roller 65 with pressure in such a manner that the printing paper 50 can be carried together with the rotation of the paper feed roller 65 without fail.

The gear 67*a* transfers a turning force of the gear 87 fitted to the paper feed motor 1 to the paper feed roller 65. The gear 67*b* transfers a turning force of a gear 37*a* to the paper discharge roller 68.

The paper discharge roller 68 carries the printing paper 50 in the feeding direction in response to the rotation of the paper feed motor 1, and then discharges the printing paper 50 after the printing is ended.

The knurled roller 69 and the paper discharge roller 68 hold the printing paper 50 therebetween to carry such printing paper 50 firmly in response to the rotation of the paper discharge roller 68.

The chassis 86 is made of a conductive member (e.g., metal, or the like) to support the paper feed motor 1, and earthing terminals of the not-shown control portion and a panel portion are connected thereto.

One end of the earthing spring member 100 is connected to a rod-like metal member constituting the paper feed roller 65 in an electrically conductive state, while the other end thereof is connected to the chassis 86 to drop off a potential of the rod-like member to a ground level as a potential of the chassis 86 (earthing).

Figure 2:
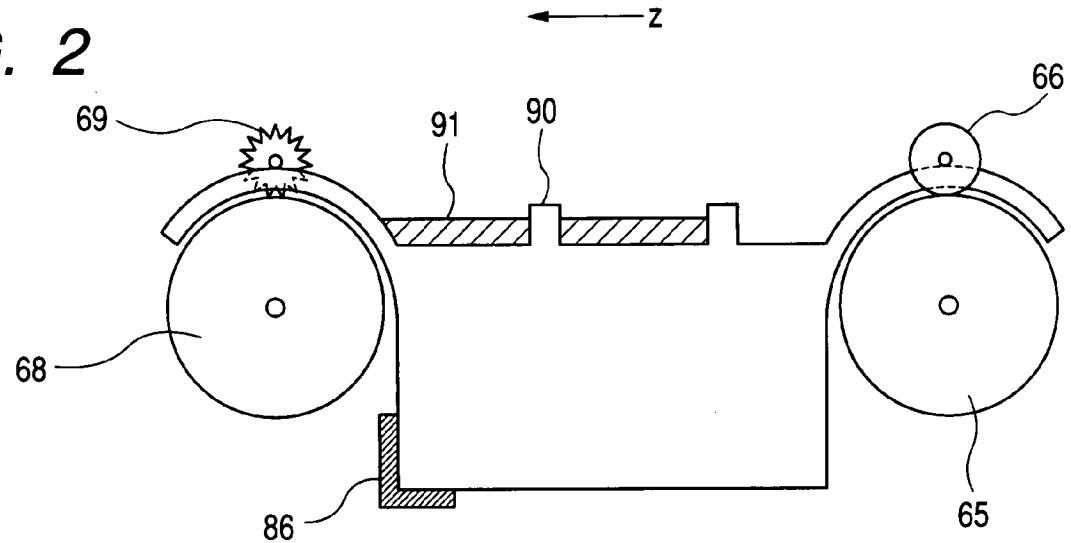
FIG. 2 is a view showing an outline of a sectional shape of the printing apparatus according to the first embodiment shown in FIG. 1.

FIG. 2 is a schematic sectional view taken when the printing apparatus according to the first embodiment shown in FIG. 1 is cut along a plane perpendicular to the X-direction (the axial direction of the paper feed roller 65) and viewed from the X-direction.

As shown in this Figure, a platen 90 is bridged between the paper discharge roller 68 and the paper feed roller 65 and has a role to support the printing paper 50.

Also, a projected portion with which the printing paper 50 comes into contact is provided to the upper portion of the platen 90.

Also, absorbing members 91 for absorbing the ink droplets ejected out of the printing paper 50 during the unframed printing are provided to the periphery of the projected portion.

Also, the chassis 86 is provided on the lower left side of the platen 90.

The idle roller 66 is pushed against the paper feed roller 65 with pressure to hold the printing paper 50 between these rollers and carry the printing paper 50 in the Z-direction.

In contrast, the knurled roller 69 is pushed against the paper discharge roller 68 to hold the printing paper 50 between these rollers, and then carries the printing paper 50 in the Z-direction to discharge after the printing is ended.

Figure 3:
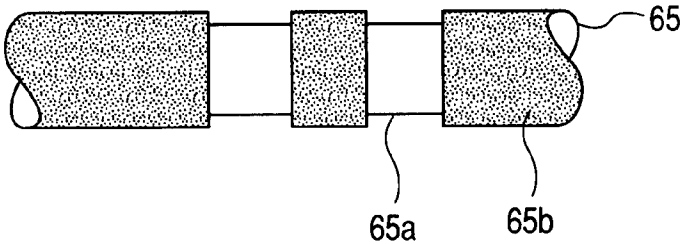
FIG. 3 is a view showing a detailed configurative example of a paper feed roller installed into the printing apparatus according to the first embodiment shown in FIG. 1.

FIG. 3 is a view showing a detailed configuration of the paper feed roller 65.

The paper feed roller 65 is constructed by coating a coating (e.g., coating containing alumina) 65*b*, which is applied to increase a friction against the printing paper 50, on a surface of a rod-like steel member made of SUM22L or SUM24L, for example.

A part of the portion of the paper feed roller 65, with which the printing paper 50 comes into contact, constitutes strip-off areas 65*a* in which the coating 65*b* is stripped off. The static electricity that is charged on the printing paper 50 is grounded to the chassis 86 via these areas.

In this embodiment, the strip-off areas 65*a* act as the conductive portion.

Next, an operation of the above embodiment will be explained hereunder.

The not-shown control portion of the printing apparatus, when received a printing instruction from a not-shown host, drives the paper feed motor 63 to rotate the paper feed roller 64 and feed only a sheet of printing papers 50 stored in the paper feed tray.

At this time, since the sensor 15 senses a top end portion of the printing paper 50, the not-shown control portion checks that the printing apparatus does not run short of the paper and continues the printing operation.

When the printing paper 50 is carried and arrives at the paper feed roller 65, the not-shown control portion drives the paper feed motor 1 to start the rotation of the paper feed roller 65 and the paper discharge roller 68. In this case, the rotation of the paper feed motor 1 may be started simultaneously with the paper feed motor 63.

When the paper feed roller 65 is rotated, the idle roller 66 is rotated correspondingly and the printing paper 50 fed by the paper feed roller 64 is inserted between them. At this time, since the strip-off areas 65*a* of the paper feed roller 65 come into contact with the printing paper 50 or come very close to the printing paper 50, the static electricity that is charged on the printing paper 50 is transferred to the rod-like member in the inside of the paper feed roller 65 via the strip-off areas 65*a*.

Since the rod-like member contacts the earthing spring member 100 shown in FIG. 1, the static electricity is grounded from the rod-like member to the chassis 86 via the earthing spring member 100.

Then, the printing paper 50 carried out from the paper feed roller 65 is fed to the upper portion of the platen 90.

Then, the not-shown control portion applies the waste printing to the upper end portion (the portion that is sucked at first) of the printing paper 50.

Next, the waste printing will be explained hereunder.

Figure 4:
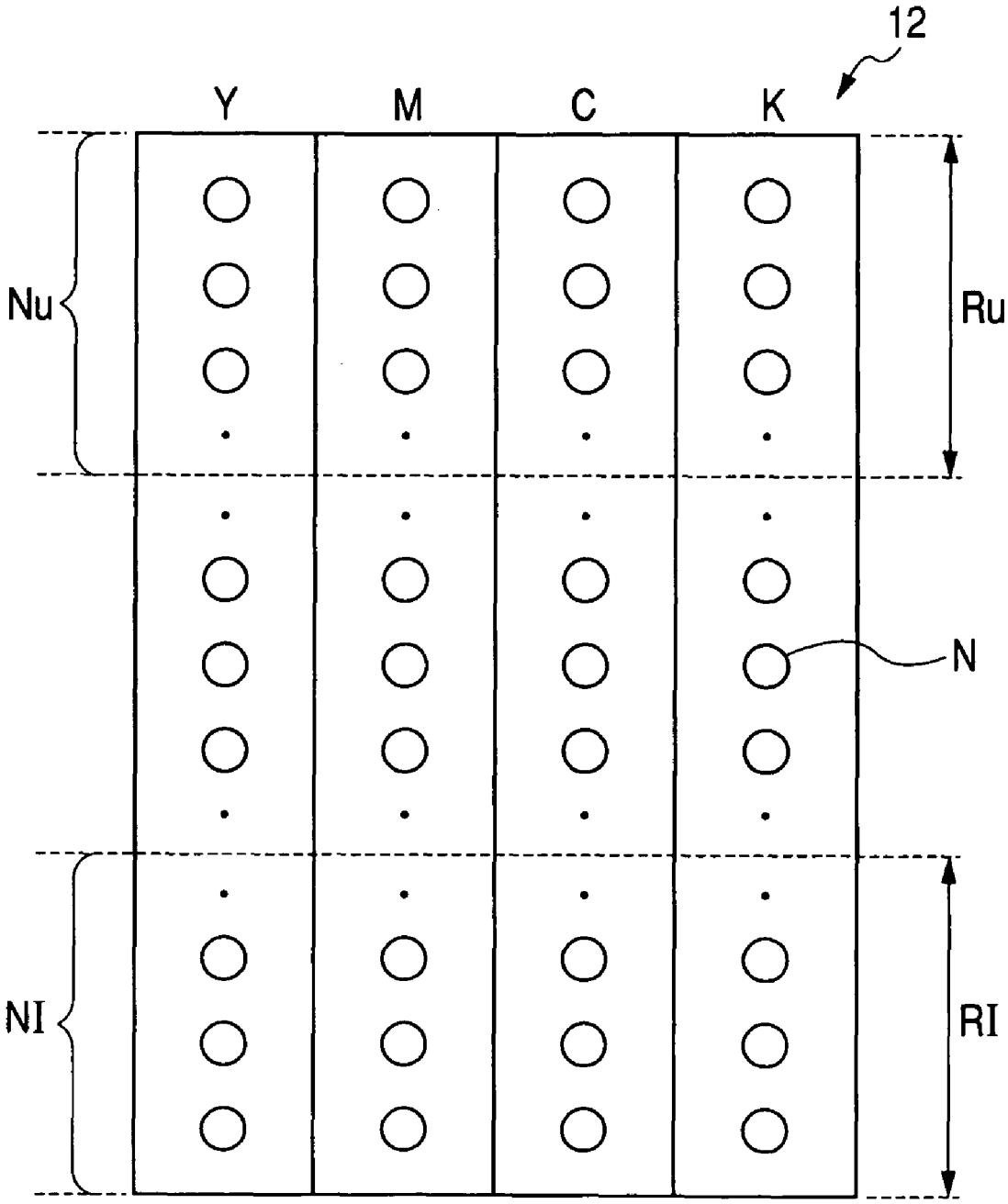
FIG. 4 is a view showing an example of an alignment of nozzles provided to a printing head of the printing apparatus shown in FIG. 1.

FIG. 4 is an explanatory view showing an alignment of nozzles N in a printing head 12.

This alignment of these nozzles consists of four sets of nozzle arrays each of which ejects the ink every color, i.e., black (K), cyan (C), magenta (M), or yellow (Y). Thus, 180 nozzles are aligned at a predetermined nozzle pitch k respectively.

Four sets of nozzle arrays are arranged to be aligned along the main scanning direction.

In this case, the "nozzle pitch" is the value indicating how many rasters (i.e., how many pixels) corresponds to the interval between the nozzles aligned on the printing head 12 in the feeding direction.

For example, the pitch k between the nozzles aligned at a three raster interval is 4. In this case, the "raster" is a column of pixels that are aligned in the main scanning direction.

Figure 5:
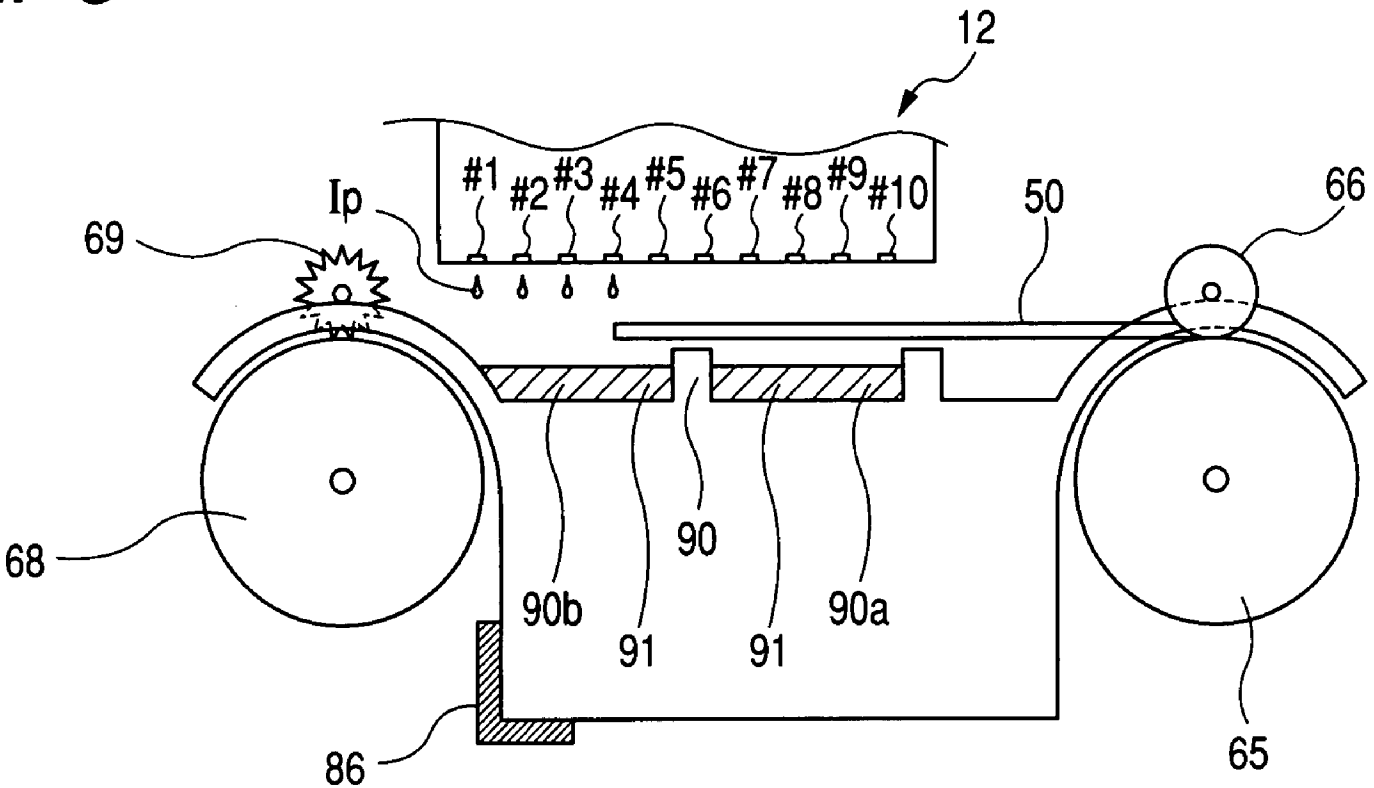
FIG. 5 is a view showing the outline of the sectional shape of the printing apparatus shown in FIG. 1 in the feeding direction, wherein a relationship between the printing head and a platen is shown.

As shown in FIG. 5, the printing head 12 is provided to a position opposing to the platen 90.

The platen 90 is arranged in the middle between the paper feed roller 65 and the paper discharge roller 68, and holds the printing paper 50 carried by the paper feed roller 65/the idle roller 66 and the paper discharge roller 68/the knurled roller 69 to keep a distance between the printing paper 50 and the printing head 12 constant.

Also, the ink absorbing materials 91 for absorbing the ink are arranged at the upper portion of the platen 90.

In FIG. 5, numerals 1 to 10 denote the nozzle number. As described above, actually about 180 nozzles are provided, but in the following the number of the nozzles is assumed as 10, for the sake of simplified explanation.

Also, in the following each nozzle is represented by affixing "#" to the nozzle number.

A range Ru indicated by a broken line in FIG. 4 corresponds to a predetermined range of the nozzles N on the printing head 12 on the upstream side (the side at which the top end of the printing paper 50 arrives first) in the feeding direction.

As shown in FIG. 5, in the platen 90 opposing to the printing head 12, an upstream-side concave portion 90*a* exists in the area corresponding to the range Ru.

That is, respective color nozzle columns #7 to #10 are provided to the position facing to the upstream-side concave portion 90*a*.

A set of respective color nozzle columns is represented as a nozzle group Nu.

Similarly, a range R1 indicated by a broken line in FIG. 4 corresponds to a predetermined range of the nozzles N on the printing head 12 on the downstream side (the side at which the top end of the printing paper 50 arrives later) in the feeding direction.

As shown in FIG. 5, in the platen 90 opposing to the printing head 12, a downstream-side concave portion 90*b* exists in the area corresponding to the range R1.

That is, respective color nozzle columns #1 to #4 are provided to the position facing to the downstream-side concave portion 90*b*.

A set of respective color nozzle columns is represented as a nozzle group N1.

Figure 6:
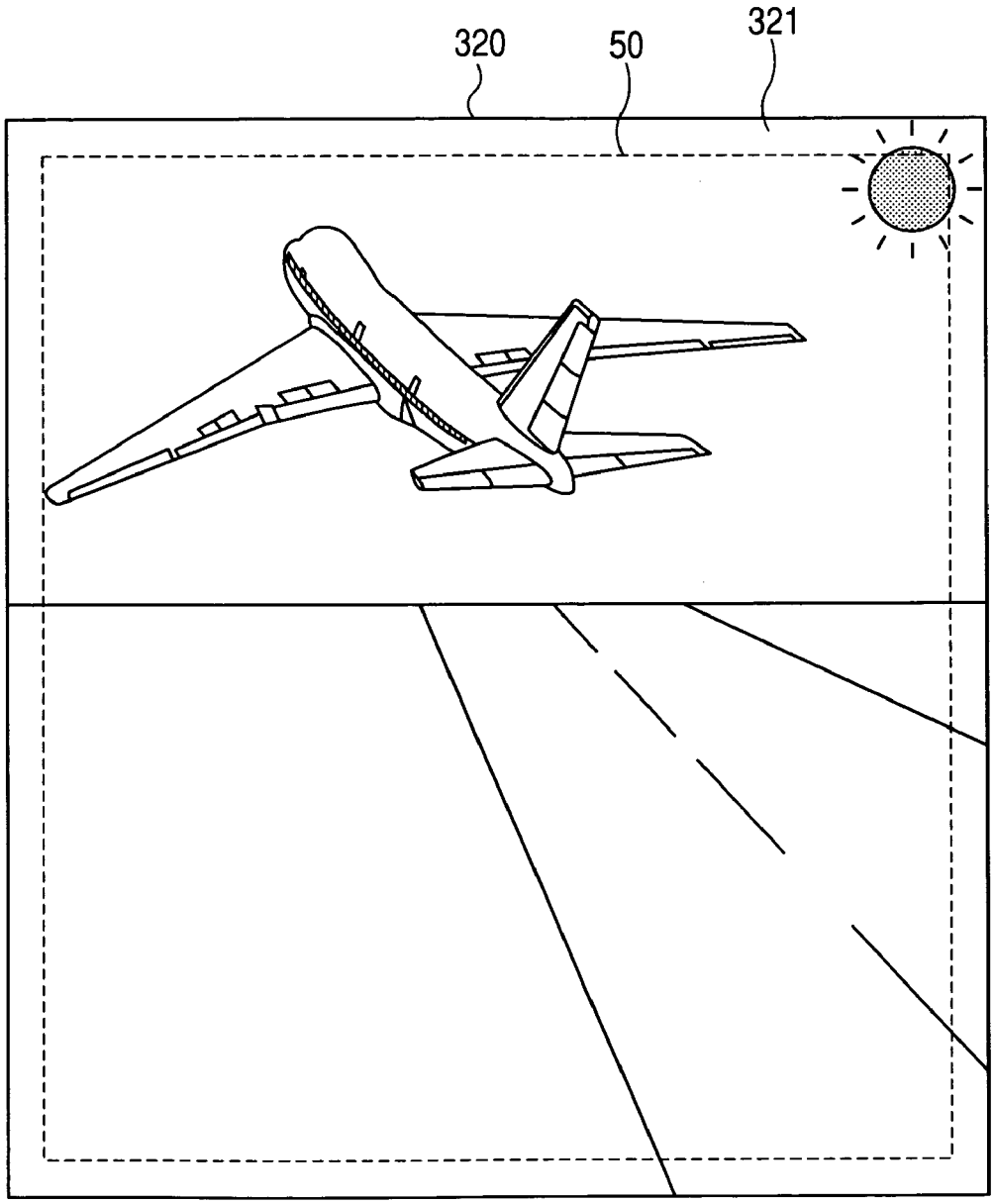
FIG. 6 is a view showing a relationship between an image printed on a printing paper and the printing paper in the printing apparatus shown in FIG. 1.

By the way, in the case of the unframed printing, in order to prevent that a blank area is formed in end portions of the printing paper 50, image data 320 is printed to protrude from the printing paper 50, as shown in FIG. 6.

That is, generation of the blank area is prevented by applying the waste printing to the upper and lower parts and the right and left parts.

In this manner, "to discharge the ink beyond the range of the printing paper 50" is called the waste printing.

Here, as shown in FIG. 5, a part of the ink droplets Ip that correspond to a projected portion 321 projected from the upper end of the printing paper 50 misses the printing paper 50 and becomes the micro ink. However, since the static electricity on the printing paper 50 is eliminated, the micro ink can be prevented from sticking onto the back surface of the printing paper 50, and the like.

Figure 7:
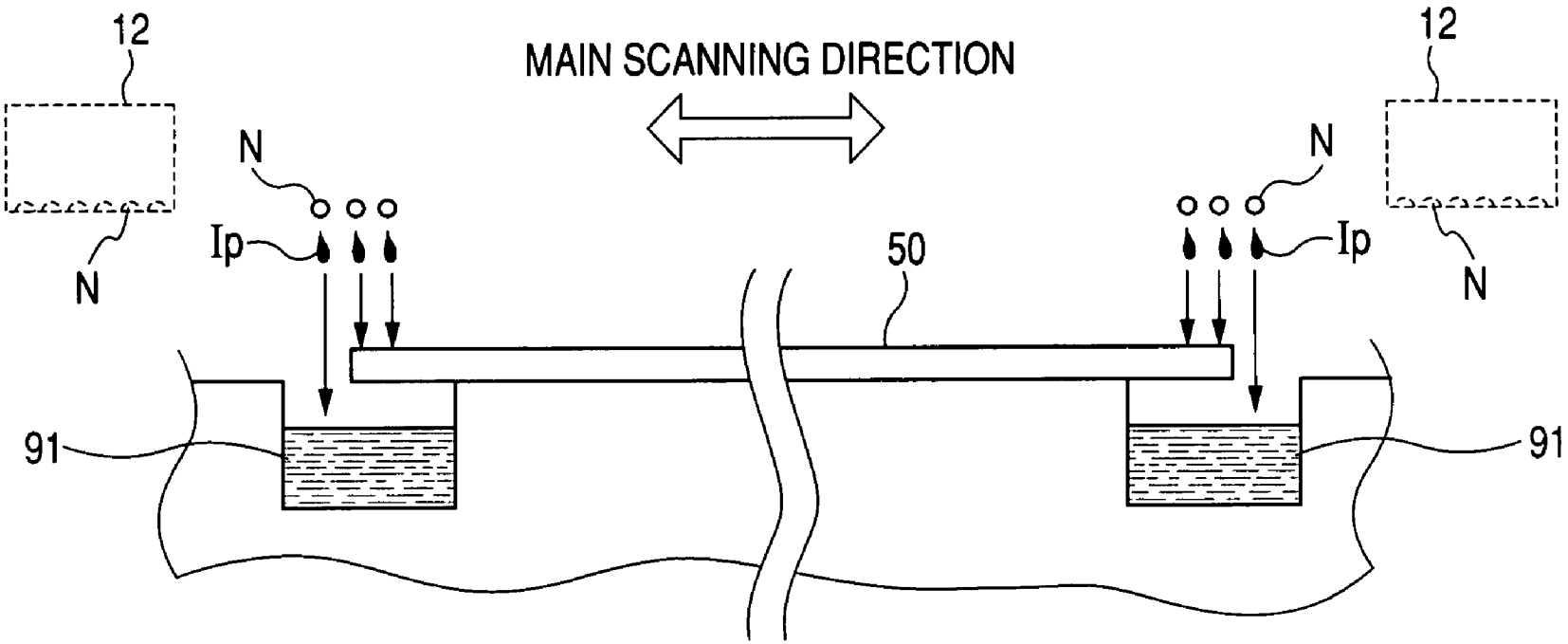
FIG. 7 is a view showing the outline of the sectional shape of the printing apparatus shown in FIG. 1 in the main scanning direction, wherein a relationship between the printing head and the platen is shown.

Then, as shown in FIG. 7, the not-shown control portion causes the carriage 3 to reciprocally move in the main scanning direction by controlling a not-shown carriage motor, and causes the desired color ink droplet to eject toward the desired position to form the dots, and also causes the printing paper 50 to move in the feeding direction by driving the paper feed roller 65.

At this time, as described above, the printing paper 50 sent out onto the platen 90 via the paper feed roller 65 is brought into a state that its static electricity is eliminated. Therefore, as shown in FIG. 7, even though the ink is ejected to miss the right and left areas of the printing paper 50 during the unframed printing, the micro ink droplets are absorbed onto unintended areas of the printing paper 50 and thus it can be prevented to smudge the front surface or the back surface of the paper.

Then, when the printing is ended, the printing paper 50 is discharged by the paper discharge roller 68 and then the printing operation is completed.

FIG. 8 is a view showing measured results of a charged potential on the printing paper 50 carried by the paper feed roller 65 having the strip-off areas 65*a* thereon and the smudge of ink.

In this Figure, a "PP2 paper" is a photoprinting glossy paper, and a "PM mat paper" is an ordinary paper without a glaze.

Also, the "prior art" shows the charged potential and the smudge of ink when the paper feed roller without the strip-off areas is used, and the "stripping off at two locations" shows the charged potential and the smudge of ink when the paper feed roller 65 having the strip-off area at two locations shown in FIG. 3 is used.

Also, the "stripping off at one location" shows the charged potential and the smudge of ink when the paper feed roller having the strip-off area at one location is used.

In addition, "○" indicates that no smudge of ink is generated on the printing paper 50, "Δ" indicates that the smudge of ink is generated within tolerance, and "X" indicates that the smudged of ink is generated at a NG (No Good) level.

As shown in this Figure, in both the PP2 paper and the PM paper, the charged potential become low rather than the prior art when the paper feed roller having the strip-off area is used.

Also, the charged potential is lowered in the case where the strip-off area is provided at two locations rather than the case where the strip-off area is provided at one location.

In the PP2 paper, the smudge of ink is given as "smudged with ink" (X) in the prior art and the stripping off at one location, but the smudge of ink is improved into "not smudged with ink" (○) in the stripping off at two locations.

In the PM mat paper, the smudge of ink is given as "smudged with ink" (X) in the prior art, but the smudge of ink is improved into "tolerance" (○) in the stripping off at one location and also the smudge of ink is improved into "not smudged with ink" (○) in the stripping off at two locations.

Figure 9:
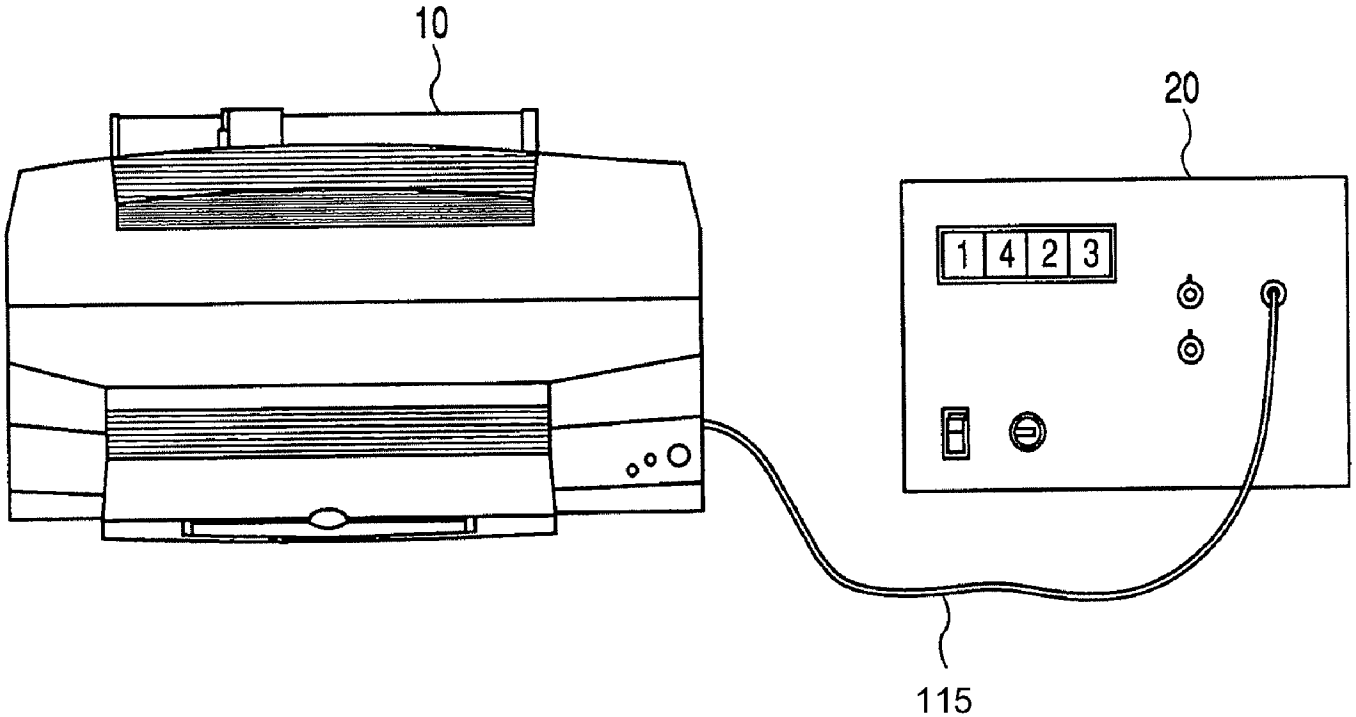
FIG. 9 is a view showing a configurative example used to measure a charged quantity of the static electricity generated in the printing paper, in the printing apparatus according to the first embodiment shown in FIG. 1.

FIG. 9 is a view showing a configuration used to measure the charged potential shown in FIG. 8.

In this Figure, a printer 10 is connected to a surface electrometer 20 via a cable 115.

Here, the surface electrometer 20 is the apparatus for measuring a potential of the static electricity charged on a surface of the printing paper 50, and measures the potential of the static electricity charged on a surface of a measuring object based on change in an electrostatic capacity generated between the surface electrometer and the measuring object, as described later.

The cable 15 connects a probe (to be described later) built in the printer 10 and the surface electrometer 20 to transmit an electric signal from the probe to the surface electrometer 20.

Figure 10:
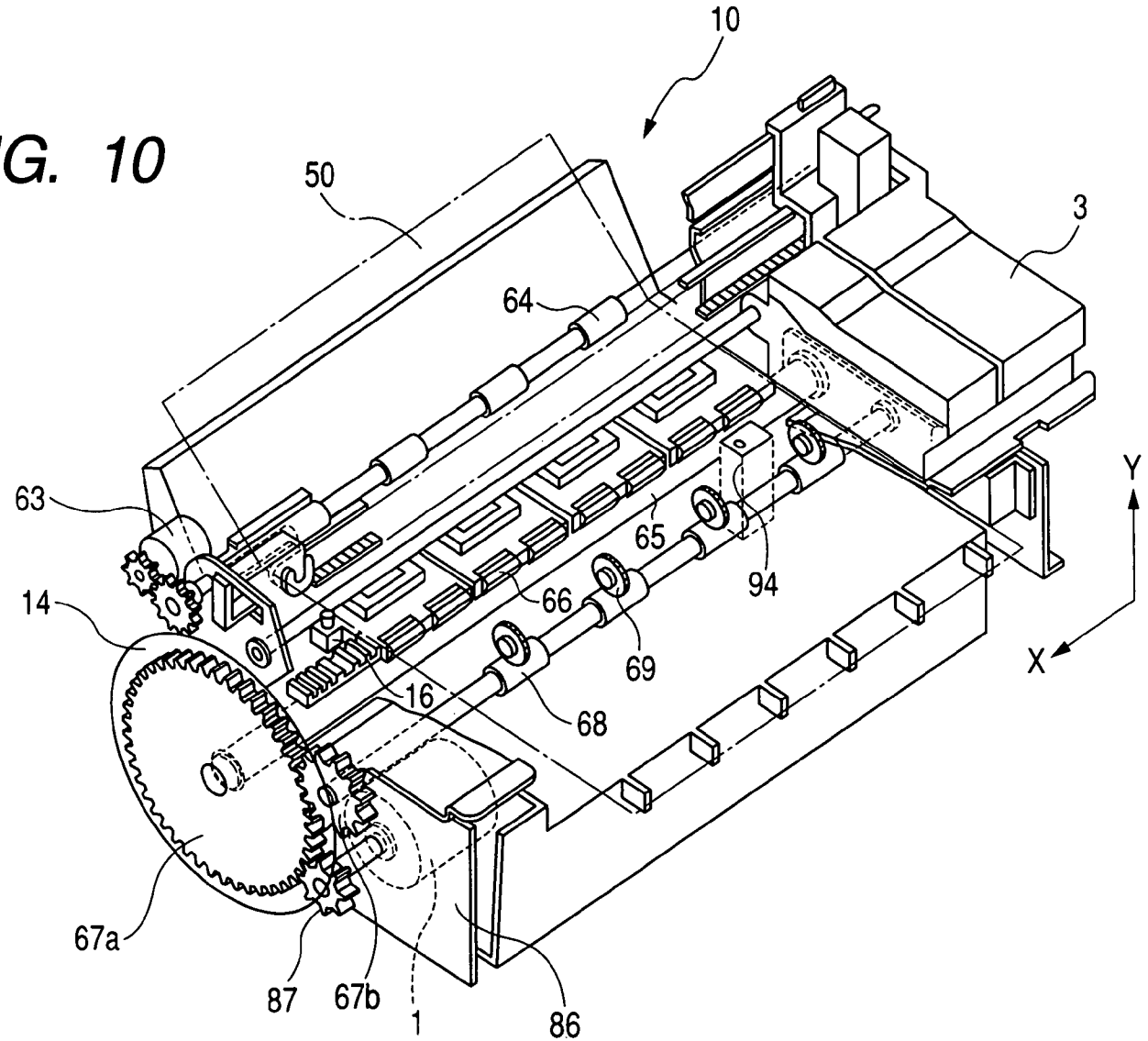
FIG. 10 is a view showing an arranged state of a probe in the embodiment shown in FIG. 9.

FIG. 10 is a view showing an arranged state of the probe 94 constituting a part of the surface electrometer 20.

As shown in this Figure, the probe 94 is arranged in a position that is close to the back surface of the printed face of the printing paper 50 and is in the vicinity of a scanning path that the printing head of the carriage 3 draws. The probe 94 measures the potential of the static electricity changed on the back surface of the printing paper 50 and then supplies the measured result to the surface electrometer 20 via the cable 115.

In this case, the probe 94 can be secured by fitting one face of a magic tape to the side surface of the probe, then fitting the other face to the inside of the platen 90 (see FIG. 3), and then engaging these magic tapes with each other.

Also, the probe 94 can be secured by providing a latching member to the inside of the platen 90 and then engaging the probe 94 with this latching member, otherwise the probe can be secured by screws.

Figure 11:
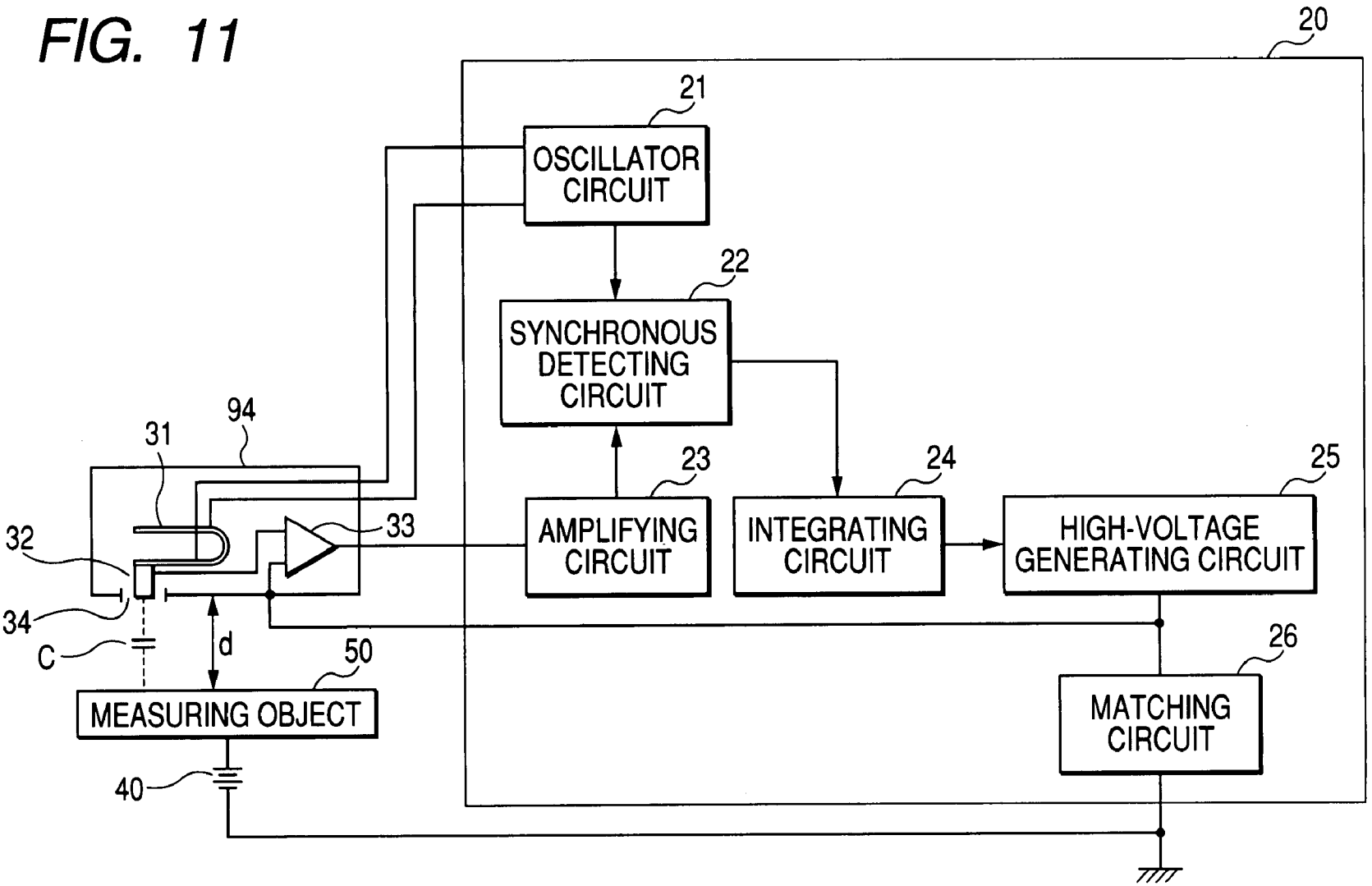
FIG. 11 is a view showing a configurative example of a surface electrometer shown in FIG. 9.

FIG. 11 is a view showing a detailed configurative example of the surface electrometer 20 and the probe 94.

As shown in FIG. 11, the surface electrometer 20 is constructed by an oscillator circuit 21, a synchronous detecting circuit 22, an amplifying circuit 23, an integrating circuit 24, a high-voltage generating circuit 25, and a matching circuit 26.

Here, the oscillator circuit 21 oscillates an alternating signal at a predetermined frequency to vibrate a tuning fork 31 described later, and supplies the alternating signal to the tuning fork 31 and the synchronous detecting circuit 22.

The synchronous detecting circuit 22 synchronously detects the signal (sensed signal) from the probe 94 amplified by the amplification circuit 23, based on the alternating signal from the oscillation circuit 21.

The amplifying circuit 23 amplifies the sensed signal output from a preamplifier 33 built in the probe 94 with a predetermined gain and outputs it.

The integrating circuit 24 integrates an output signal from the synchronous detection circuit 22 and then outputs the resultant result to the high-voltage generation circuit 25.

The high-voltage generating circuit 25 generates a high voltage corresponding to the output from the integration circuit 24 and outputs it.

The matching circuit 26 is a circuit that controls an output impedance of the high-voltage generation circuit 25 to have a predetermined value.

Meanwhile, the probe 94 is constructed by the tuning fork 31, a sensor electrode 32, the preamplifier 33, and a sensing window 34.

Now, the tuning fork 31 is excited by the alternating signal supplied from the oscillation circuit 21 and vibrates at a predetermined frequency.

The sensor electrode 32 is fitted to one of vibrating portions of the tuning fork 31, and vibrates vertically in FIG. 11 in answer to the vibration of the tuning fork 31.

The preamplifier 33 amplifies a minute vibration voltage sensed by the sensor electrode 32 with a predetermined gain, and outputs it.

That is, the preamplifier 33 takes the part of an impedance transformer.

The sensing window 34 is a window provided to expose the sensor electrode 32. The potential of the static electricity charged on the printing paper 50 as the measuring object is measured through this sensing window 34.

In this case, the measuring object is the printing paper 50 in this example. Also, a bias voltage 40 applied to the measuring object is the applied voltage to generate a voltage in response to change in the electrostatic capacity C.

Next, an operation executed to measure the electrostatic voltage by the above surface electrometer 20 will be explained hereunder.

When the not-shown control portion of the printer 10 receives the printing instruction from the not-shown host or when a predetermined button on the operation panel of the printer 10 is operated, such control portion rotates the paper feed roller 64 by driving the paper feed motor 63 and feeds only a sheet of the printing papers 50 stored in the paper feed tray.

At this time, since the sensor 16 senses the top end portion of the printing paper 50, the not-shown control portion recognizes that the printing apparatus does not run of the paper, and continues the paper feeding operation.

When the printing paper 50 is carried and arrives at the paper feed roller 65, the not-shown control portion drives the paper feed motor 1 to start the rotation of the paper feed roller 65 and the paper discharge roller 68.

In this case, the rotation of the paper feed motor 1 may be started simultaneously with the paper feed motor 63.

When the paper feed roller 65 is rotated, the idle roller 66 is rotated correspondingly and the printing paper 50 fed by the paper feed roller 64 is inserted between them.

The printing paper 50 receives the driving forces of the paper feed roller 65 and the idle roller 66 and is fed to the upper portion of the platen 90.

Meanwhile, the printing paper 50 is sandwiched and carried by the paper feed roller 65 and the idle roller 66. The static electricity due to the peeling-off is generated when the printing paper 50 is peeled off from the paper feed roller 65 and the idle roller 66.

Also, a plurality of members for guiding the printing paper 50 are present over the route through which the printing paper 50 is fed onto the platen 90. Thus, the static electricity is also generated by the friction between these members and the printing paper 50.

In other words, the printing paper 50 fed to the upper portion of the platen 90 by the driving forces of the paper feed roller 65 and the idle roller 66 is positioned over the sensing window 34 of the probe 94.

At this time, the tuning fork 31 of the probe 94 is vibrating by the alternating signal supplied from the oscillation circuit 21 at a predetermined frequency.

As a result, the sensor electrode 32 fitted to the vibrating portion of the tuning fork 31 also vibrates in the vertical direction in FIG. 11 in answer to the vibration of the tuning fork 31.

The electrostatic capacity C is formed between the sensor electrode 32 and the printing paper 50 as the measuring object according to a distance d between the sensor electrode 32 and the printing paper 50. Since this distance d is varied in response to the vibration of the tuning fork 31, the electrostatic capacity C is also varied in response to the vibration.

Here, since the bias voltage 40 is applied to the sensor electrode 32 and the printing paper 50 as the measuring object, the vibration voltage corresponding to the electrostatic capacity C (the voltage obtained by applying the AM (Amplitude Modulation) to the surface potential) is applied to the sensor electrode 32.

The preamplifier 33 amplifies this vibration voltage (impedance transformation), and then supplies the resultant voltage to the amplifying circuit 23 via the cable 115.

The amplifying circuit 23 amplifies the vibration voltage supplied from the preamplifier 33, and supplies the resultant voltage to the synchronous detecting circuit 22.

The synchronous detecting circuit 22 synchronously detects the vibration voltage output from the amplifying circuit 23 based on the alternating signal supplied from the oscillator circuit 21, and extracts a mixed wave of an upper side band (USB) and a lower side band (LSB), for example, and outputs it.

The integrating circuit 24 integrates a positive voltage component of the mixed wave of USB and LSB as the output signal of the synchronous detecting circuit 22, for example, and output it.

The high-voltage generating circuit 25 generates the high voltage in accordance with the output signal of the integrating circuit 24 and outputs it. Since the output of the high-voltage generating circuit 25 is grounded to a casing of the probe 94, the potential of the probe 94 itself is increased gradually according to the high-voltage generating circuit 25.

Then, the electrostatic capacity C is canceled when a surface potential of the printing paper 50 becomes equal to a potential of the probe 94. Thus, an output from the sensor electrode 32 becomes "0" and thus an output of the integrating circuit 24 also becomes "0", and therefore increase of the potential of the high-voltage generating circuit 25 is stopped.

A predetermined voltage corresponding to the output voltage of the high-voltage generating circuit 25 at this time is digitally displayed, for example, on a display portion of the surface electrometer 20 as the measured result, i.e., the surface potential of the printing paper 50.

At this time, the matching circuit 26 controls to divide the voltage of the high-voltage generating circuit 25 and reduce the output impedance lower than a predetermined value. Thus, it can be prevented that the large error is generated in the measured value according to a length of the distance between the probe 94 and the printing paper 50.

Then, when the printing paper 50 is moved on the platen 90 and its top end reaches the position just under the nozzle of the carriage 3, the waste printing is executed in the case where the whole printing is carried out and then a predetermined color ink is printed on the top end portion of the printing paper 50.

As a result, a streak of line is printed on the top end portion of the printing paper 50.

When the waste printing is completed, the image data are supplied subsequently and the desired image is printed on the printing paper 50. Upon the waste printing and the printing of the image data, the surface electrometer 20 still continues to measure the potential of the static electricity that is charged on the back surface of the printing paper 50.

In the case where the whole printing is not carried out, the printing paper 50 is carried to the area in which the image is printed and then the image data are supplied and the printing of the image is started.

Also, when the whole printing is not carried out but the image data are printed, the surface electrometer 20 still continues to measure the potential of the static electricity that is charged on the back surface of the printing paper 50.

Then, when the printing of the image proceeds and the top end of the printing paper 50 comes up to the paper discharge roller 68, the printing paper 50 is discharged gradually toward the outside of the printer 10 because such printing paper 50 is sandwiched between the paper discharge roller 68 and the knurled roller 69 and receives the driving force.

At this time, the static electricity is also generated when the printing paper 50 is separated from the paper discharge roller 68. However, since the printing has already been ended, this static electricity seldom acts as the cause of the smudge on the printing paper 50, whereby such static electricity is excepted from the measuring objects.

When all the printing is completed, the paper discharge roller 68 is rotated and the printing paper 50 is discharged from the printer 10.

With the above operation, the charged voltage shown in FIG. 8 can be measured.

In the first embodiment shown above, the strip-off area 65*a* is provided at two locations of the paper feed roller 65. In this case, as described above, the strip-off area 65*a* may be provided only at one location or at three locations or more.

However, the strip-off area 65*a* must be brought into contact with the printing paper 50 even if any size printing paper is used.

The micro ink is liable to particularly stick to the back surface of the printing paper 50. Therefore, in the case of the printing paper such as a postcard, or the like in which not only the front surface of the paper but also the back surface is used, particularly a necessity to prevent generation of the smudge of ink is enhanced.

Accordingly, the strip-off areas may be arranged to optimize the sheet such that such charging of the printing paper 50 can be eliminated effectively.

More particularly, the strip-off area is positioned at the center portion of the postcard, or the like.

Further, in the first embodiment shown above, a relationship between the strip-off area 65*a* and the idle roller 66 is not mentioned. In this case, if the strip-off area 65*a* is set to position just under the idle roller 66, the static electricity can be eliminated without fail because the printing paper 50 is pushed against the strip-off area 65*a* with pressure by the pressure of the idle roller 66.

Further, according to such configuration, the static electricity generated by the contact and the separation between the strip-off area 65*a* and the printing paper 50 can be eliminated surely.

Further, in the first embodiment shown above, the rod-like member of the paper feed roller 65 is grounded to the chassis 86 via the earthing spring member 100. But the earthing method except for this method may be employed.

For example, the rod-like member can be grounded by connecting the bearing by which the rod-like member of the paper feed roller 65 is held to the chassis 86.

In addition, the similar advantage can be achieved by connecting the rod-like member of the paper feed roller 65 to the conductive portion (e.g., the ground terminal of the cable that is connected to the host) having the large electrostatic capacity other than the chassis 86.

Further, in the first embodiment shown above, the strip-off area 65*a* is formed by stripping off the coating 65*b* on the surface of the paper feed roller 65. But the area from which the inner rod-like member is exposed may be formed simultaneously with the coating.

Further, the conductive member made of a metal thin film, or the like, for example, may be provided to at least a part of the paper feed roller 65*a* in place of the strip-off area 65*a*, and then this conductive member may be earthed.

Next, a second embodiment of the present invention will be explained hereunder.

Figure 12:
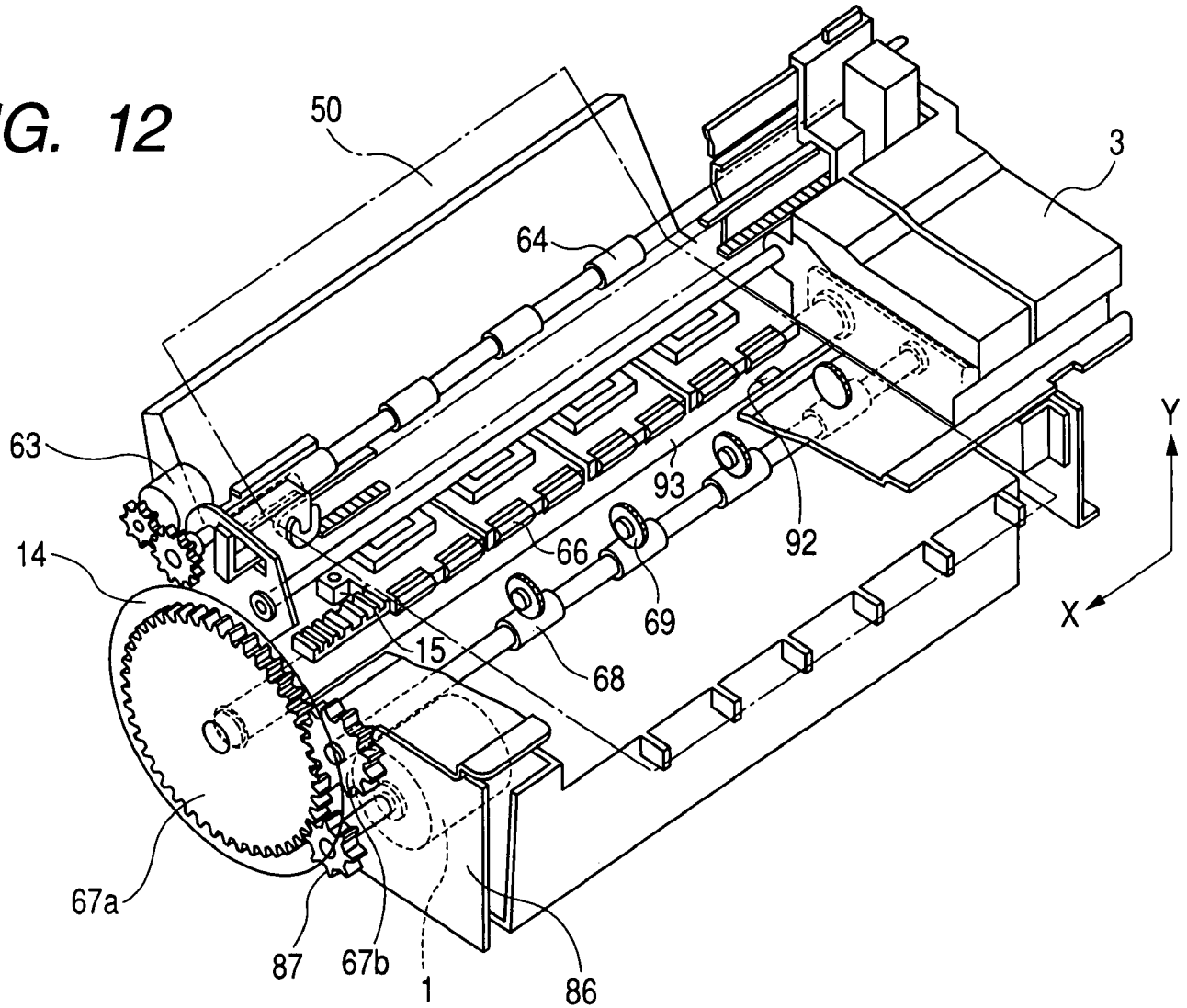
FIG. 12 is a view showing a configurative example of a printing apparatus according to a second embodiment of the present invention.

FIG. 12 is a view showing a configuration of a printing apparatus according to a second embodiment of the present invention.

In this Figure, the identical reference symbols are affixed to the portions corresponding to the case in FIG. 1 and their explanation will be omitted herein.

In the second embodiment of the present invention, in contrast to the case in FIG. 1, the paper feed roller 65 is replaced with a ordinary paper feed roller 93 without the strip-off area 65*a*, and also the earthing spring member 100 is removed.

In addition, a copper foil 92 is provided newly to the convex portion of the platen 90, and is earthed to the chassis 86 by a conductive wire 95 described later.

Figure 13:
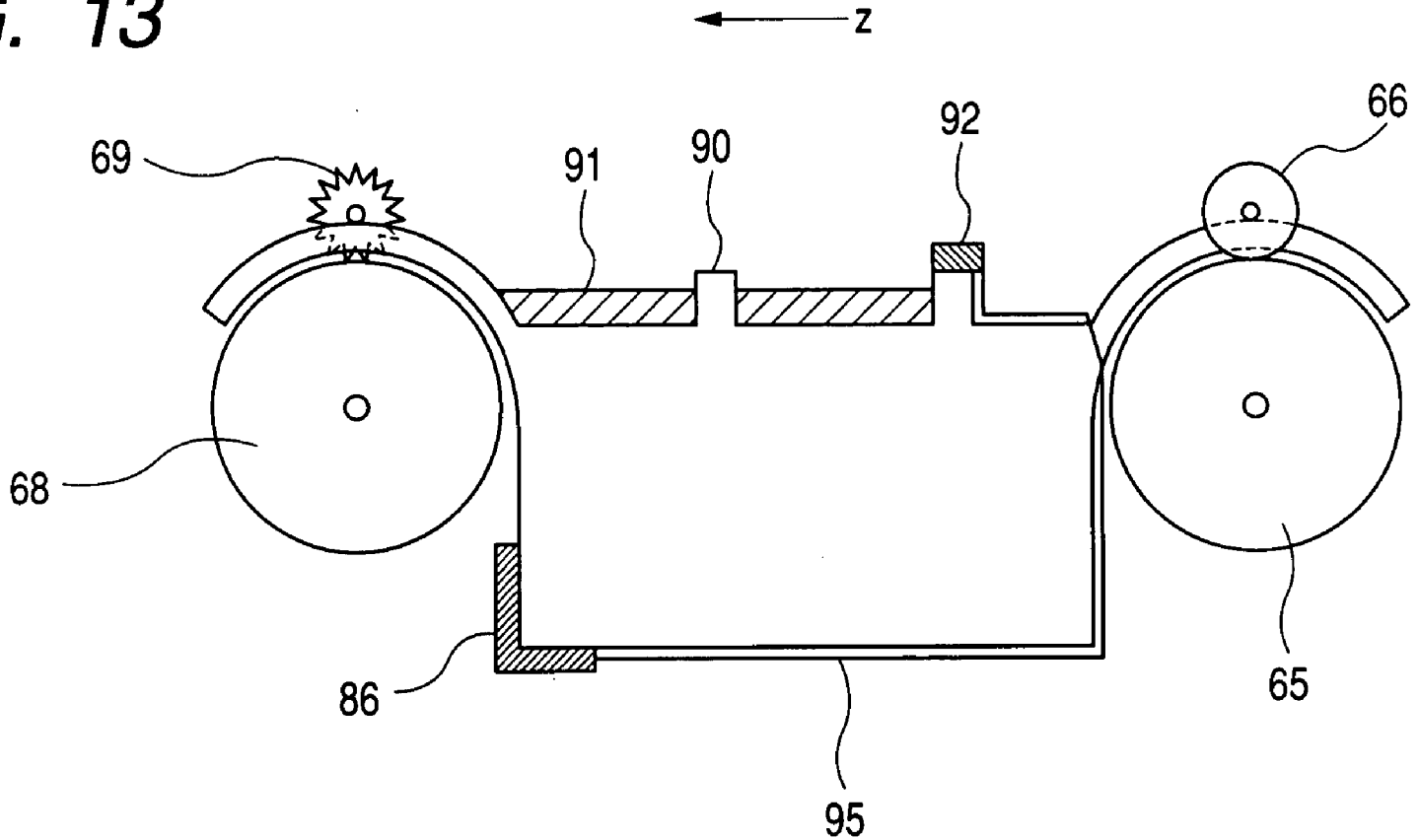
FIG. 13 is a view showing an outline of a sectional shape of the printing apparatus according to the second embodiment shown in FIG. 12.

FIG. 13 is a schematic sectional view taken when the printing apparatus shown in FIG. 12 is cut along a plane perpendicular to the X-direction and viewed from the X-direction. In this Figure, the identical reference symbols are affixed to the portions corresponding to the case in FIG. 2 and their explanation will be omitted herein.

In the example in this Figure, the copper foil 92 is provided to the convex portion of the platen 90, and the copper foil 92 and the chassis 86 are connected by the conductive wire 95. Therefore, the copper foil 92 is set to the same potential as the chassis 86.

Next, an operation of the second embodiment will be explained hereunder.

The second embodiment is different from the first embodiment in that the charging of the printing paper 50 is eliminated by the copper foil 92 instead of the paper feed roller 65.

Since other operations are similar to the case in the first embodiment, their detailed explanation will be omitted herein.

FIG. 14 is a view showing measured results of the charged potential of the printing paper 50 and the smudge of ink when the copper foil 92 is provided and when the copper foil 92 is not provided like the prior art.

As shown in this Figure, when the copper foil 92 is provided, the charged potential is lowered rather than the prior art in both the PP2 paper and the PM mat paper.

Also, in the PP2 paper, the smudge of ink is improved from "smudged with ink" (X) to "not smudged with ink" (○) when the copper foil 92 is provided.

While, in the PM mat paper, the smudge of ink is improved from "smudged with ink" (X) to "tolerance" (Δ).

Figure 15:
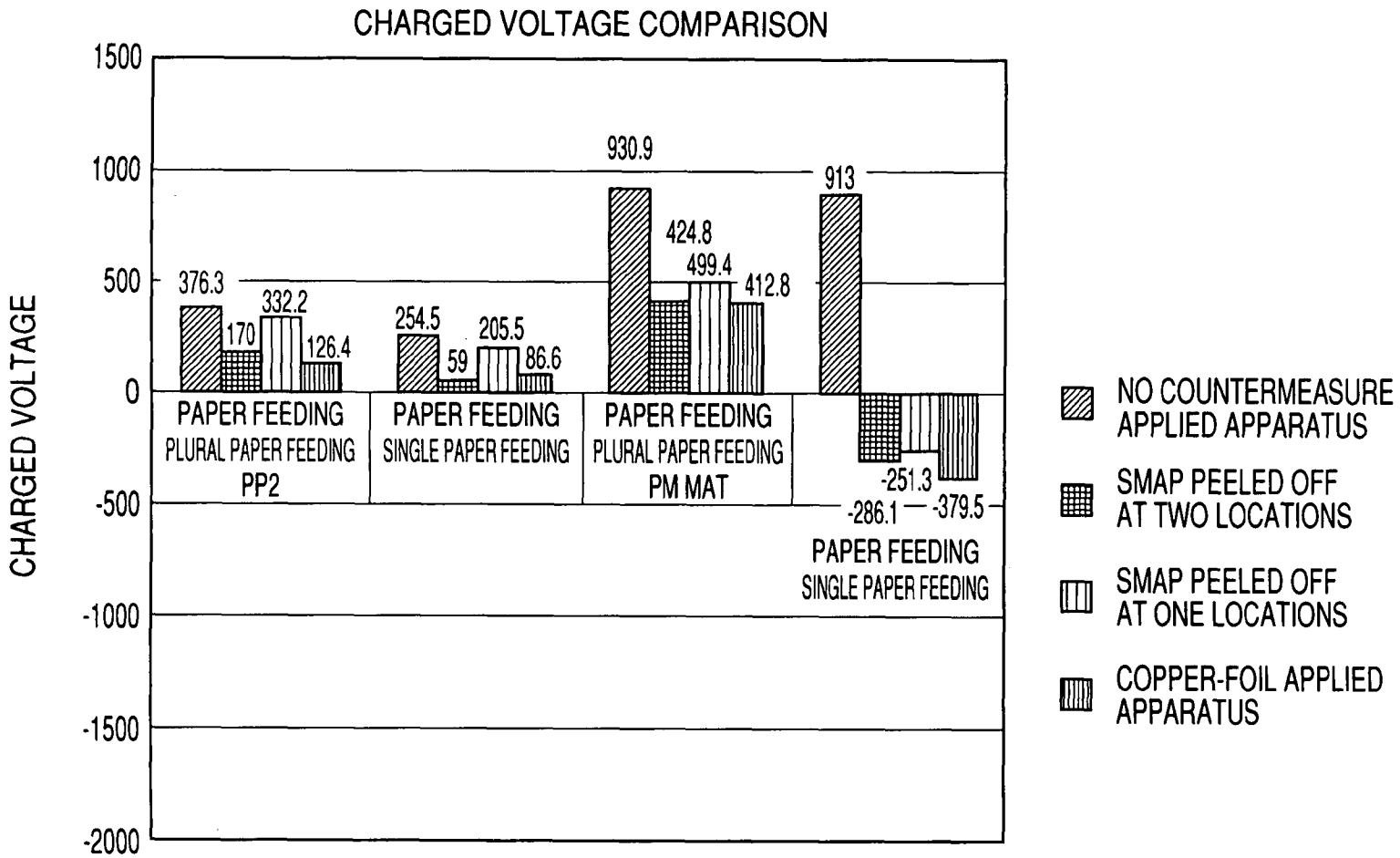
FIG. 15 is a view showing a relationship between types of countermeasures against charging and a charged voltage, wherein respective situations of the charged voltage are illustrated when plural paper feeding and single paper feeding are carried out by using the printing apparatuses according to the first and second embodiments and the printing apparatus in which no countermeasure is taken respectively, while using the PP2 paper and the PM mat paper.

FIG. 15 is a view showing the type of charging countermeasure and measured results of the charged voltage shown in the first and second embodiments.

In this Figure, respective groups (groups each consisting of four bar graphs) show the charged voltage in the case where a plurality of PP2 papers are fed from the left side (the case where the measurement is executed after several printing papers are fed), the case where a single PP2 paper is fed (the case where the printing paper fed for the first time is measured), the case where no countermeasure is taken when a plurality of PM mat papers are fed and a single PM mat paper is fed (prior art), the case where the strip-off area 65*a* is provided at two locations of the paper feed roller 65 (the first embodiment), the case where the strip-off area 65*a* is provided at one location of the paper feed roller 65 (the first embodiment), and the case where the copper foil 92 is provided (the second embodiment).

As apparent from this Figure, the charged voltage is lowered in the case where a single paper is fed rather than the case where a plurality of papers are fed.

Also, the charged voltage is lowered in the PP2 paper in contrast to the PM mat paper.

In addition, in comparison with the prior art in which no countermeasure is taken, the charged voltage is lowered in the present embodiment in which the charging countermeasure is taken.

In the second embodiment shown above, as shown in FIG. 12, the copper foil 92 is provided to a part of the convex portion of the platen 90. But the copper foil 92 may be provided to the position different from this position.

In this case, the position of the copper foil 92 must be set on the upstream side rather than the area to which the ink is ejected from the carriage 3.

That is, this is because it is preferable that the ink should be ejected after the static electricity is eliminated.

Also, the copper foil having a wider area than that shown in FIG. 12 may be provided.

For example, if a conductive member for covering a part or all of the printed area (the area that the ink impacts) on the platen 90 is provided, charges having the opposite polarity to the charges that are charged on the printing paper come together on the surface of the conductive member and act to cancel the charge on the printing paper 50. As a result, since the charging of the printing paper 50 can be eliminated apparently from the overall printed area, the printing paper 50 can be prevented from being smudged with the micro ink droplets.

Since it is the peripheral portions (the upper and lower ends and the left and right ends, especially the upper end) of the printing paper 50 that have the high probability that the micro ink droplets are generated as described above, the copper foil may be provided around such portions.

Further, as described in the explanation in the first embodiment, an arrangement of the copper foil 92 or the conductive member may be decided to eliminate effectively the charging of the printing paper such as the postcard, or the like from which the smudge of ink cannot be disregarded.

Concretely the copper foil 92 is arranged to be positioned in the center portion on the upper end of the postcard, or the like.

Further, not the copper foil but other type conductor (the aluminum foil, the conductive plastics, or the like) may be used.

Further, in the case where the charged potential of the printing paper 50 is high, if the conductive member having a sharp tip is arranged to direct such sharp tip to the printing paper 50, the corona discharge is generated from the sharp tip of the conductive member by the point effect. Thus, the charges having the opposite polarity to the charged charges on the printing paper 50 are radiated, and thus the charging can be eliminated (canceled).

In addition, in the second embodiment shown above, the copper foil 92 is provided to the lower side of the printing paper 50 (the back side of the printed surface). But the copper foil or the conductive member may be provided to the upper side (the printed surface side).

According to such configuration, the charging of the printing paper 50 can be eliminated effectively.

In such case, the sticking of the micro ink droplets can also be prevented effectively if the conductive members are arranged mainly on the peripheral portions of the printing paper 50.

In the above embodiments, the explanation will be made mainly of the static electricity elimination. In this case, if the printing paper 50 is prevented from being charged, it can also be prevented that the micro ink droplets are adsorbed in the unintended positions.

Figure 16A:
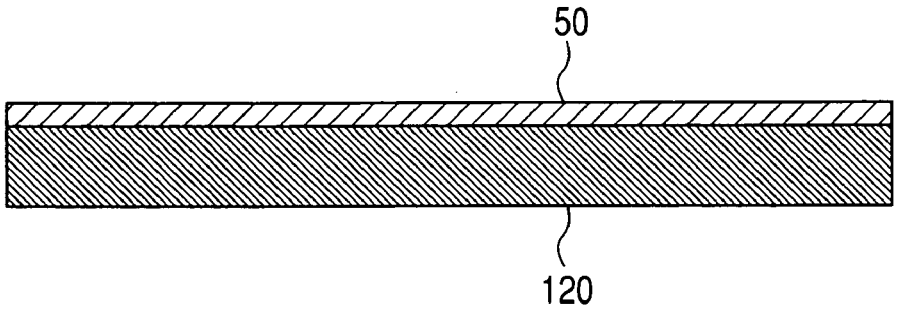
FIG. 16 is a view showing an example of a configuration used to suppress generation of the static electricity.
Figure 16B:
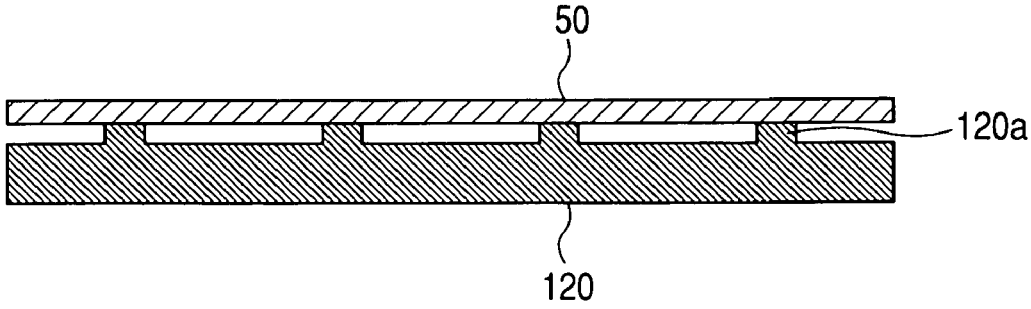

For example, in the case where a member 120 that exists on the path through which the printing paper 50 passes comes into contact with the printing paper 50 over the overall surface, as shown in FIG. 16(A), a generated amount of the static electricity can be suppressed if a contact area with the printing paper 50 is reduced by providing convex portions 120*a* onto a surface of the member 120, as shown in FIG. 16(B).

Figure 17:
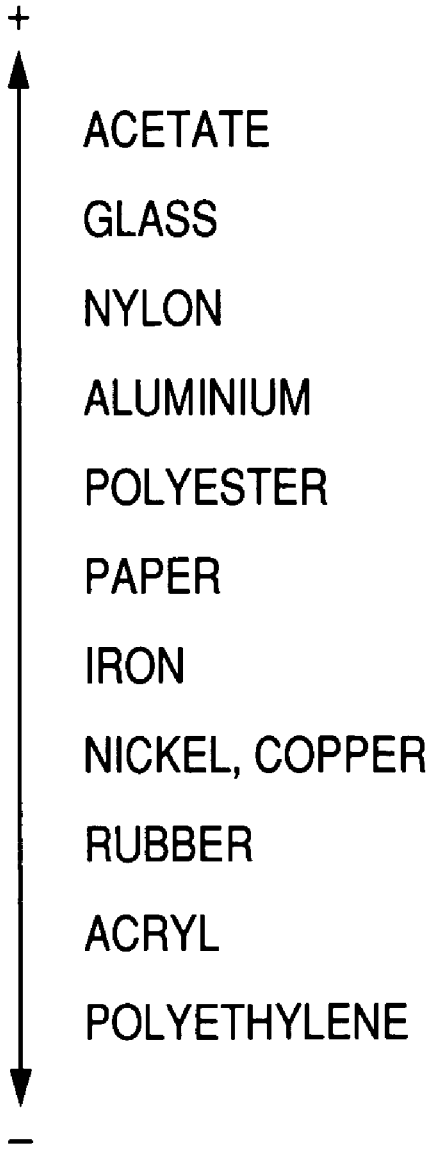
FIG. 17 is an example of a charging sequence table indicating a charging polarity and a charging level when members are rubbed together.

Also, a charged amount of the static electricity generated when two types of members are rubbed is relevant to the mutual distance between these members in a charging sequence table shown in FIG. 17. Therefore, a charged amount of the static electricity can be lessened by selecting the members having a shorter mutual distance in the charging sequence table.

For example, since the polyethylene is positioned farther away from the paper constituting the printing paper 50 than the rubber (since a distance between the paper and the polyethylene is longer than a distance between the paper and the rubber), a charged amount of the rubber is smaller than that of the polyethylene when the paper and the rubber are rubbed and the paper and the polyethylene are rubbed.

Accordingly, in the printing apparatus, if the members that exist on the path through which the printing paper 50 passes and come into contact with the printing paper 50 are made of the material that located in the vicinity of the paper in the charging sequence table shown in FIG. 17, a charged amount of the printing paper 50 can be reduced and also the adsorption of the micro ink droplets can be prevented.

With the above, one embodiment of the present invention is explained. But the present invention may be varied variously in addition to this.

For example, as the conductive member constituting a static electricity eliminating mechanism, the paper feed roller 64 may be made of the conductive rubber or plastics and the printing apparatus may be earthed via the paper feed roller 64.

Further, the earthing unit constituting the static electricity eliminating mechanism may be connected to the ground (earth), for example, other than the chassis 86. In short, such earthing unit may be connected to the conductive member having the large electrostatic capacity.

Further, as the static electricity generation preventing mechanism, a coating for preventing generation of the static electricity (e.g., a coating such as material located near the paper, surfactant, and the like in the charging sequence shown in FIG. 17) may be applied to surfaces of the members that are arranged on the path through which the printing paper 50 passes.

Further, in the above embodiments, the conductive portion is provided to the paper feed roller 65. In this case, for example, the conductive portion may be provided to the idle roller 66. In such case, the conductive portion may be provided to the portion that is a part of the idle roller 66 and contacts to the printing paper 50.

Alternately, the conductive portion may be constructed by forming the idle roller 66 by the conductive member, then coating an insulating member on the surface, and then stripping off a part of the coating.

INDUSTRIAL APPLICABILITY

According to the printing apparatus and the printing method described in claims 1 to 14, there is provided the static electricity eliminating mechanism for eliminating the static electricity generated on the printing paper by the conductive member that is arranged in the position to which the ink droplet is ejected from the nozzle or the upstream side of such position on the path through which the printing paper passes. Therefore, the ink droplet ejected from the nozzle can be prevented from being adsorbed in the unintended position by the influence of the static electricity generated on the printing paper, and also the printing paper can be prevented from being smudged by the micro ink droplet.

Also, this static electricity eliminating mechanism is particularly effective in the printing mode in which the ink droplet can be ejected from the nozzle to the area that is out of the size of the printing paper (i.e., the unframed printing mode), and has very great industrial applicability.

In this case, the present invention is not limited to the above embodiments.

The invention claimed is:

1. A printing apparatus for forming a dot in a desired position of a printing sheet by ejecting an ink droplet from a nozzle, comprising:

a static electricity eliminating mechanism, which eliminates static electricity generated on the printing sheet by a conductive portion that is arranged in a position to which the ink droplet is ejected from the nozzle or an upstream side of such position on a path through which the printing sheet passes;

wherein the conductive portion is formed in at least one of a sheet feed roller and an idle, roller that carries the printing sheet;

wherein the sheet feed roller or the idle roller comprises a conductive rod-shaped member having an insulating coating on a surface thereof;

wherein the sheet feed roller or the idle roller comprises stripped-off portions where the insulating coating is stripped off so as to expose the conductive rod-shaped member;

wherein the stripped-off portions are configured to substantially eliminate static electricity of the printing sheet;

wherein the insulating coating is configured to apply a friction force between the sheet feed roller or the idle roller and the printing sheet;

wherein the friction force is substantially uniform in a longitudinal direction of the sheet feed roller or the idle roller;

wherein the stripped-off portions are configured to transfer static electricity of the printing sheet to the conductive rod-shaped member; and wherein the stripped-off portions are configured such that the conductive rod-shaped member contacts the printing sheet during operation of the printing apparatus.

2. The printing apparatus as set forth in claim 1, further comprising:

an earthing unit, which earths the conductive portion.

3. The printing apparatus as set forth in claim 1, wherein the conductive portion is formed in the sheet feed roller.

4. The printing apparatus as set forth in claim 1, wherein the conductive portion is formed in the idle roller.

5. The printing apparatus as set forth in claim 3 or 4, further comprising:

an earthing unit, which earths the sheet feed roller constituting the conductive portion or the idle roller constituting the conductive portion.

6. The printing apparatus as set forth in claim 1, wherein the rod-shaped member of the sheet feed roller or the idle roller is connected to the printing apparatus so that the static electricity generated on the printing sheet is discharged to the printing apparatus through the conductive portion.

7. The printing apparatus as set forth in claim 6, wherein a strip-off portion of the coating on the sheet feed roller is formed at least at two locations; and wherein the idle roller is formed so as to push the printing sheet by the strip-off portion.

8. The printing apparatus as set forth in claim 1, wherein the conductive portion is a conductive member that is arranged in the position to which the ink droplet is ejected from the nozzle or the upstream side of such position on the path through which the printing sheet passes and is connected to a chassis that is different from a paper feed member.

9. The printing apparatus as set forth in claim 8, wherein the conductive portion is a conductive member having a sharp tip; and wherein the sharp tip is arranged to be directed to the printing sheet.

10. The printing apparatus as set forth in claim 1, wherein a plurality of projected portions are formed on a contact surface with which the printing sheet comes into contact on the path through which the printing sheet passes to reduce a contact area.

11. The printing apparatus as set forth in claim 1, wherein a material of a member constituting the path through which the printing sheet passes is configured by selecting material that is near material of the printing sheet in a charging sequence table.

12. The printing apparatus as set forth in claim 1, wherein a surface of a member constituting the path through which the printing sheet passes is coated with material or a surfactant that is near material of the printing sheet in a charging sequence table.

13. The printing apparatus as set forth in claim 1, further comprising:

a printing unit, which ejects the ink droplet from the nozzle to an area that is out of a size of the printing sheet.

14. The printing apparatus as set forth in claim 1, wherein an ink absorbing member for absorbing the ink droplet ejected to an outside of the printing sheet is arranged on a platen.

* * * * *